US012090379B2

(12) United States Patent
Sartore

(10) Patent No.: US 12,090,379 B2
(45) Date of Patent: Sep. 17, 2024

(54) SUPPORT DEVICE FOR BICYCLE FRONT WHEEL

(71) Applicant: ELITE S.R.L., Fontaniva (IT)

(72) Inventor: Andrea Sartore, Fontaniva (IT)

(73) Assignee: ELITE S.R.L., Fontaniva (IT)

( * ) Notice: Subject to any disclaimer, the term of this patent is extended or adjusted under 35 U.S.C. 154(b) by 24 days.

(21) Appl. No.: 17/559,588

(22) Filed: Dec. 22, 2021

(65) Prior Publication Data

US 2022/0203198 A1 Jun. 30, 2022

(51) Int. Cl.
*A63B 69/16* (2006.01)

(52) U.S. Cl.
CPC ..... *A63B 69/16* (2013.01); *A63B 2069/162* (2013.01); *A63B 2069/163* (2013.01); *A63B 2225/093* (2013.01)

(58) Field of Classification Search
CPC ..... A63B 69/16; A63B 2069/162; A63B 2069/163; A63B 2225/093; A63B 21/00192; A63B 21/005; A63B 21/008; A63B 21/0085; A63B 2069/165; A63B 2225/09; A63B 71/023; A63B 22/0605; A63B 22/0023
USPC ..... 248/177.1, 178.1; 482/57, 61, 65
See application file for complete search history.

(56) References Cited

U.S. PATENT DOCUMENTS 4,775,145 A * 10/1988 Tsuyama ..... A63B 21/0052 482/901
4,802,666 A * 2/1989 Rodriqguez ..... G09B 9/058 482/61
5,042,795 A * 8/1991 Bursik ..... A63B 69/16 482/61
6,712,737 B1 * 3/2004 Nusbaum ..... A63B 69/16 482/8
7,691,033 B2 * 4/2010 Rolli ..... A63B 22/0056 482/146
7,736,282 B1 * 6/2010 Horowitz ..... A63B 69/16 482/61
10,112,098 B2 * 10/2018 Smits ..... A63B 69/16
10,384,111 B2 * 8/2019 Liao ..... A63B 24/0087
10,695,638 B2 * 6/2020 Hawkins, III ..... A63B 24/0062
11,141,625 B2 * 10/2021 McAllister ..... A63B 22/0605
2006/0229163 A1 * 10/2006 Waters ..... A63F 13/22 482/8
2009/0283648 A1 11/2009 Chiang et al.
2011/0039664 A1 * 2/2011 Cooper ..... A63B 24/0087 482/61
2016/0096098 A1 * 4/2016 Wang ..... A63B 23/0476 482/61

(Continued)

FOREIGN PATENT DOCUMENTS

EP 0995466 A1 4/2000
GB 2561830 A 10/2018

(Continued)

*Primary Examiner* — Muhammad Ijaz
(74) *Attorney, Agent, or Firm* — Volpe Koenig

(57) ABSTRACT

A support device for a bicycle includes a support structure, a fixing group supported on the support structure and a movable element and a retention element configured to retain the front fork of the bicycle. The support device further includes a raising/lowering device of the fixing group, the retention element is translatable jointly with the movable element, and the retention element is rotatably connected to the movable element.

15 Claims, 6 Drawing Sheets

(56) References Cited

U.S. PATENT DOCUMENTS

| | | | | |
|---|---|---|---|---|
| 2018/0008856 | A1* | 1/2018 | Radow | A63B 69/16 |
| 2018/0369675 | A1* | 12/2018 | Papadopoulos | A63B 69/16 |
| 2019/0022457 | A1* | 1/2019 | Porwal | A63B 21/4009 |
| 2019/0022497 | A1* | 1/2019 | Hawkins, III | A63B 24/0087 |
| 2020/0324840 | A1* | 10/2020 | Maxfield | A63B 26/003 |
| 2021/0162291 | A1* | 6/2021 | Lee | A63B 69/16 |
| 2022/0203197 | A1* | 6/2022 | Sartore | A63B 71/023 |
| 2022/0203198 | A1* | 6/2022 | Sartore | A63B 71/023 |
| 2022/0387870 | A1* | 12/2022 | Yu | A63B 22/0605 |

FOREIGN PATENT DOCUMENTS

| | | | |
|---|---|---|---|
| JP | 2018121809 | A | 8/2019 |
| NL | 2006702 | C2 | 11/2012 |
| WO | 2007083341 | A1 | 7/2007 |
| WO | 2019018416 | A1 | 1/2019 |

* cited by examiner

SUPPORT DEVICE FOR BICYCLE FRONT WHEEL

FIELD OF THE INVENTION

This invention relates to a support device for a bicycle front wheel, of a type that may be used in conjunction with a roller support for a bicycle rear wheel or other related training device.

BACKGROUND

So-called rollers or trainers are widely used in the cycling sector. These devices are intended for training in enclosed spaces, whereby the bicycle may be supported on fixed supports and produce an adjustable braking action on the pedal stroke.

In the context of these devices, there is a need to be able to recreate situations and conditions that are increasingly similar to those that actually occur when cycling on the road and outdoors in general.

In the context of this need, several solutions have been developed to recreate the real conditions that the cyclist may experience during outdoor training and that work interactively with the cyclist's activity.

With a view to this interactivity, front wheel supports have also been developed that may simulate the conditions that occur on the handlebars during cycling and possibly detect the movement of the handlebars during training.

An example of such a support type is described in the Dutch patent NL2006702, which refers to a front wheel support comprising an inclined support plane, provided with a seat for the wheel and rotating on a base about a non-vertical axis.

A further front wheel support solution is described in US 2009 283648. This patent application describes a support structure for a front wheel of a bicycle in which the support plane for the wheel is arranged horizontally and is rotatable with respect to a vertical axis.

Another solution developed with a view to increasing interactivity is represented by supports that are able to simulate the gradient of the road surface by tilting the bike up or down to reproduce uphill or downhill stretches. This position may then be accompanied by an appropriate variation in pedaling resistance offered by the roller or trainer to simulate uphill or downhill conditions.

An example of such a support is described in the international patent application WO 2019/018416, which relates to a bicycle training device comprising a guide element, with an essentially vertical development, and a block designed to attach to the front hub of the bicycle. The block is able to slide along the guide element by means of a belt actuated by an electric motor. The guide element is thus able to slide the block in a substantially vertical direction, whereby the front end of the bicycle is raised and lowered.

However, there is a need for even greater interactivity, and in particular to provide a training device that may combine both the function of raising/lowering the front end and that of being able to simulate the steering movement in an appropriate way.

However, the problem underlying this invention is how to provide a support device for a bicycle front wheel that is structurally and functionally designed to solve at least partially one or more of the drawbacks mentioned in reference to the prior art cited above.

A further object is to provide a front wheel support device to simulate the steering movement during cycle training with a simple structure.

It is also an object of this invention to provide a front wheel support device capable of simulating the steering movement suitable to ensure a sufficient sensation of stability for the user.

SUMMARY

This problem is solved, and these objects are achieved, at least in part, by the invention by means of a bicycle front fork support device comprising a support structure intended to rest on a support surface, for example on the ground, a fixing group supported on the support structure and comprising a movable element and a retention element configured to retain the front fork.

The support device further comprises a raising/lowering device for the fixing group configured to move said movable element in a vertical direction.

The retention element is preferably translatable jointly with said movable element.

The retention element of the fork is also rotatably connected to the movable element that is moved by the raising/lowering device.

It will be appreciated that the possibility of combined movement of the fixing element of the fork, which is capable of both raising/lowering and completing rotations with respect to the support structure, makes it possible to carry out, during bicycle training on rollers or trainers, a complete simulation of the cycling experience, making it possible both to recreate the uphill and downhill conditions and to provide the support device with steering capacity.

According to one aspect of the invention, the retention element defines a locking axis for the fork, which preferably coincides with the front wheel axle of the bicycle when the fork is fixed to the fixing group.

In this way it is possible to fix the bicycle to the support device using systems similar to those traditionally used for fixing the wheel to the fork, typically a quick-release screw.

In some embodiments, the retention element is rotatable relative to the movable element about a main axis perpendicular to the locking axis, said main axis preferably being substantially vertical. According to a further aspect, the retention element is rotatable with respect to the movable element with respect to a secondary axis perpendicular to the locking axis and the main axis, said secondary axis being preferably substantially horizontal.

In yet another aspect, the retention element is translatable along said locking axis.

It will be appreciated that the envisaged movement of the retention element allows the bicycle handlebars to be turned while keeping the bicycle frame, and in particular the rear end, locked. It must be understood that the bicycle steering axis typically has a direction inclined with respect to the vertical, and the Applicant has observed that the movement of the fork due to the steering movement may be reproduced by the combination of two rotations and one translation. This occurs advantageously regardless of the geometry of the bicycle.

However, it is evident that different combinations of movements may be envisaged, and some of these may be entrusted to the roller or trainer on which the training is carried out. Furthermore, for solutions involving small steering angles of rotation, smaller movements, even simple rotation about the main axis, may also be sufficient if the resilient deformability of the bicycle frame and/or the structure supporting it may compensate for the movements of the fork.

In some embodiments, the fixing group comprises elastic return means configured to return said retention element to a rest position, preferably to a central position with respect to extreme end positions in translation along said locking axis.

According to preferred embodiments, the fixing group comprises a pin connected to said movable element and extending along said secondary axis and supporting a cradle to which an additional pin is pivotally connected, which supports a support arm to which said retention element is connected.

This feature makes it possible to obtain a structure that is resistant to the repeated stresses to which the device is subjected during training with a solution that is at the same time compact.

Preferably, angular detection means are provided, which are configured to detect an angular position of said retention element about said main axis. This makes it easy to implement an interactive—also known as smart—steering control system.

Preferably the additional pin supports a magnetic element configured to be detected by said angular detection means. In some embodiments, the magnetic element is located at a longitudinal end of said additional pin. The pin may also have a through-slot through which said additional pin extends.

These features each contribute to a compact implementation of the steering angle detection system.

In some embodiments of the invention, the raising/lowering device comprises a guide element with preferably vertical development. This guide element is preferably in the form of an elongated column.

These features make it possible to create a solid, and at the same time compact, structure, suitable for raising/lowering the bicycle fork with respect to a neutral position which coincides with the position that the bicycle would normally have when traveling on level ground.

According to a further aspect, the guide element is secured to the support structure in such a way that it may oscillate with respect to said support structure about an axis substantially parallel to said locking axis.

In some embodiments, the support device further comprises connection means configured to slidably secure said fixing group to said support structure in such a way as to allow movements of the fixing group with respect to the support structure along a compensating direction that is transverse to the vertical direction.

It will be appreciated that the possibility of movement and/or rotation of the fixing body with respect to the support structure allows for the distance of the fixing group with respect to the position of the rear axle of the bicycle to be compensated during bicycle training on rollers or trainers.

In this way it is possible to move the front end of the bicycle up or down, thus simulating a sloping position, while ensuring maximum stability of the structure as the fixing body is slidably secured to the support structure on the ground.

Preferably the raising/lowering device comprises a support base. The guide element is connected to the support base. In some embodiments, the support base is essentially rectangular in shape. Preferably, the support structure is elongated in such a way as to define a longitudinal direction, the compensation direction being substantially parallel to the longitudinal direction.

According to another aspect, the connection means comprise a pair of rails and respective sliders that are slidable in said rails. The support structure may comprise sliders and the raising/lowering device may comprise rails or vice versa. Preferably the sliders are in the form of slidable rods in said rails. In some embodiments, each of said rails comprises a first and a second portion arranged at opposite ends of said support structure along said compensation direction.

These features enable a slidable connection between the fixing body and the support structure to be obtained in a simple, robust, and therefore reliable, manner over time.

Preferably, the connection means further comprise a return element configured in such a way as to urge said raising/lowering device to an intermediate position along said compensation direction between respective limit positions.

In this way the raising/lowering device is maintained, in the absence of strains, in an intermediate position, simplifying the positioning of the bicycle on the support device.

According to still further aspects of the invention, the translational means comprise means for actuating the fixing group configured to translate the fixing group along said vertical direction which preferably comprise a screw and an internally threaded bush, said fixing group being connected to said internally threaded bush. Preferably, the actuating means comprise an anti-rotation device for the bush with respect to the column guide element, so that the translation of the movable element is obtained as a result of the rotation of the screw.

In some embodiments, the retention element comprises a first and a second locking element, each locking element being configured so as to lock a respective arm of the fork, said locking elements being aligned along said locking axis. Preferably the compensation direction is transverse to this locking axis.

Due to these features, it is possible to effectively lock the front fork, ensuring the stability of the bicycle during training.

In some embodiments, the locking axis forms an angle of between 90° and 60° with the compensation direction.

According to another aspect, the invention also relates to the use of the aforesaid support device for bicycle training.

According to yet another aspect, the invention relates to a bicycle training kit comprising the aforesaid support device and a rear wheel training device, such as a roller or trainer.

Advantageously, the support device for the fork and rear wheel training device are configured in such a way that the compensation direction defined by the support device coincides with the direction of longitudinal development of the bicycle.

Further preferred features of the invention are more generally defined by the dependent claims.

BRIEF DESCRIPTION OF THE DRAWINGS

These features and the advantages associated therewith will also be more evident from the detailed description of some preferred embodiments of the invention which will be illustrated, by way of non-limiting example, with reference to the accompanying drawings wherein.

DETAILED DESCRIPTION OF THE PREFERRED EMBODIMENTS

Figure 1:
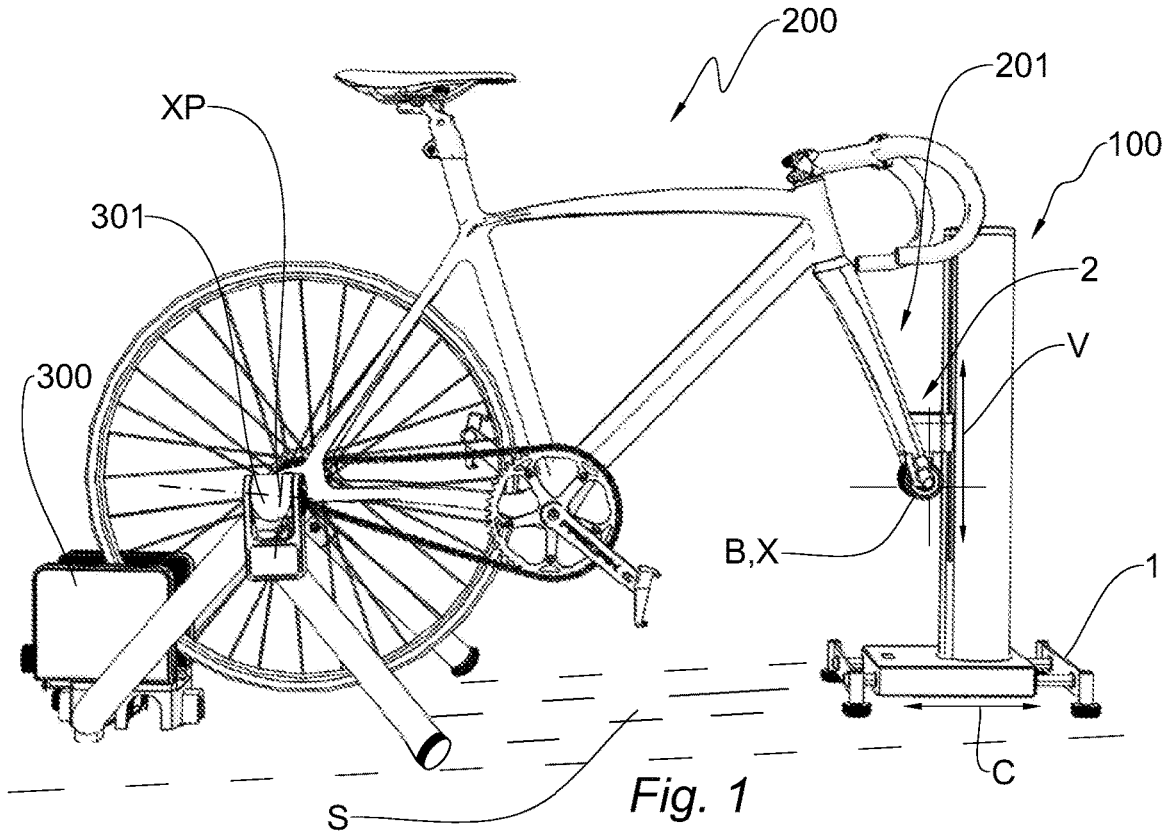
FIG. 1 is a side view of a support device according to this invention when used for bicycle training in association with a bicycle roller.

Referring initially to FIG. 1, a bicycle front wheel support device 200 is indicated as a whole with the reference number 100.

The support device 100 of this invention may be used advantageously in conjunction with a training device 300, for example a roller or trainer, comprising a support 301 by means of which the bicycle may be supported at its rear wheel axle XP. The training device 300 is configured in such a way as to allow pedaling to be simulated.

For this object, the device 300 is advantageously provided with a brake, such as a magnetic, fan, hydraulic, or electromechanical brake, to counteract the user's pedaling which is transmitted either by one or more toothed sprockets on which the chain meshes or by means of a roller driven by friction from the tire of the rear wheel. In other words, the device of this invention may form a training kit together with a device 300 or other similar system.

As may be seen from the figure, during training, the fork 201 of the bicycle is fixed to the support device 100 in the manner described in more detail below.

Figure 2:
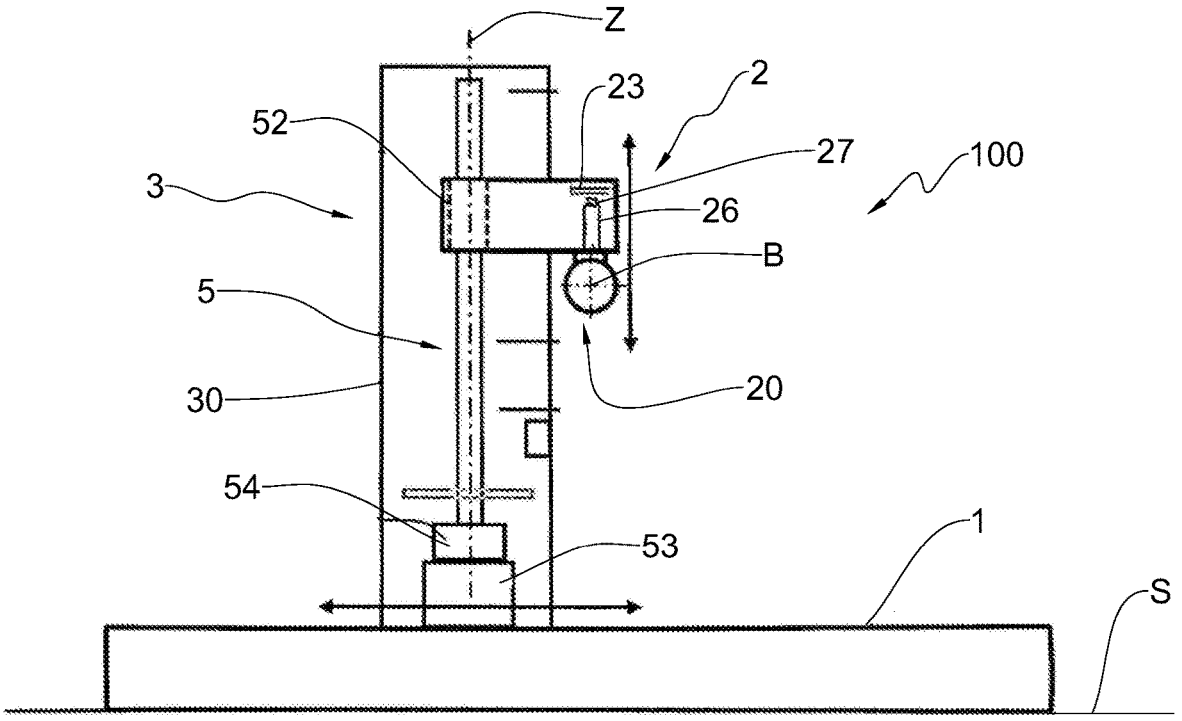
FIG. 2 is a schematic illustration of the support device of this invention, partially in section.

Referring now also to FIG. 2, the support device 100 comprises a support structure 1 intended to be supported against a substantially flat support surface S, for example the floor of a room in which the training is carried out.

Still in reference to FIGS. 1 and 2, the support device 100 further comprises a fixing group 2 configured to retain the front fork 201.

Figure 3:
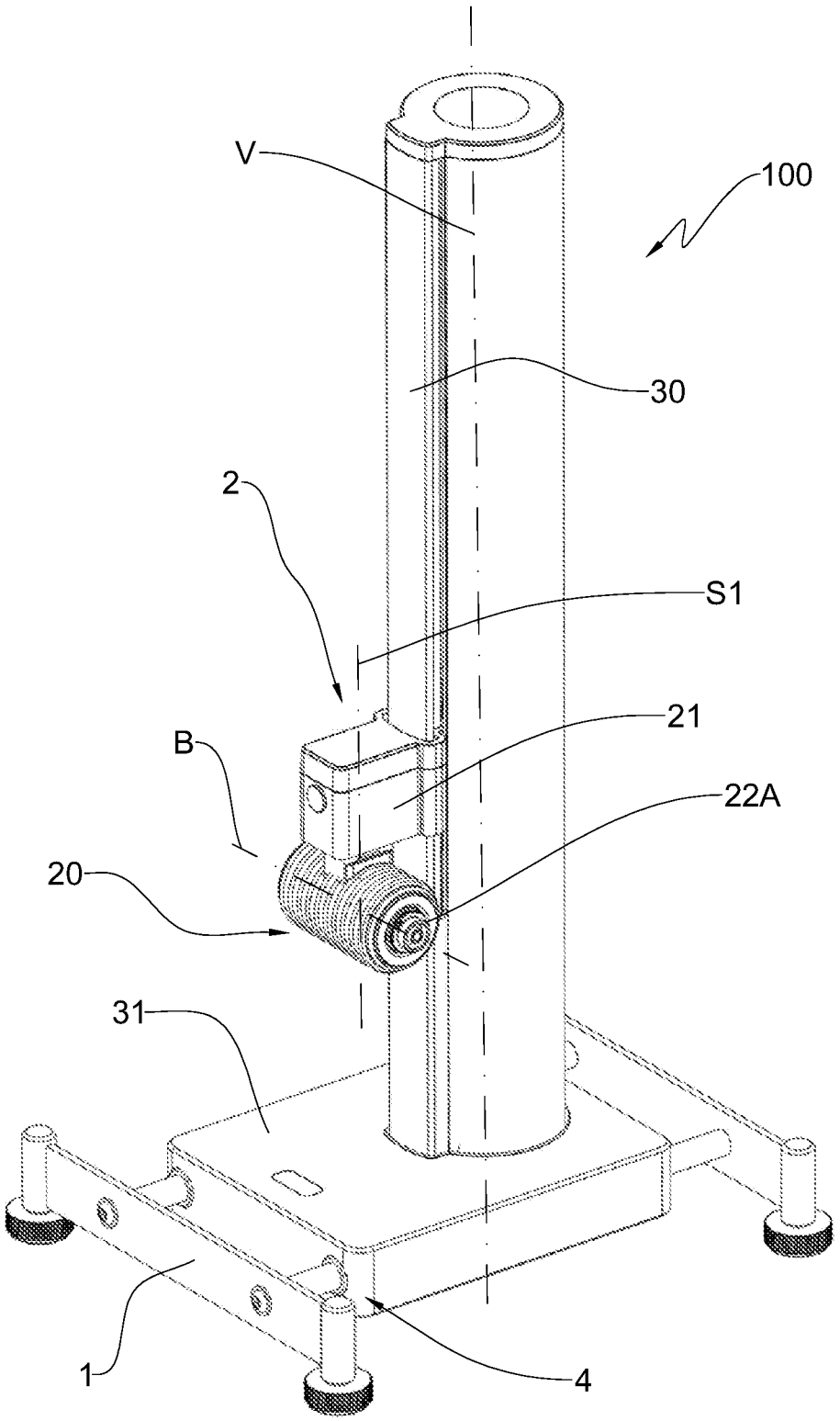
FIG. 3 is a perspective view of the support device in FIG. 1.

As illustrated in FIG. 3, in some embodiments the fixing group 2 may comprise a retention element 20 configured to define a locking axis B of the fork 201.

Figure 5:
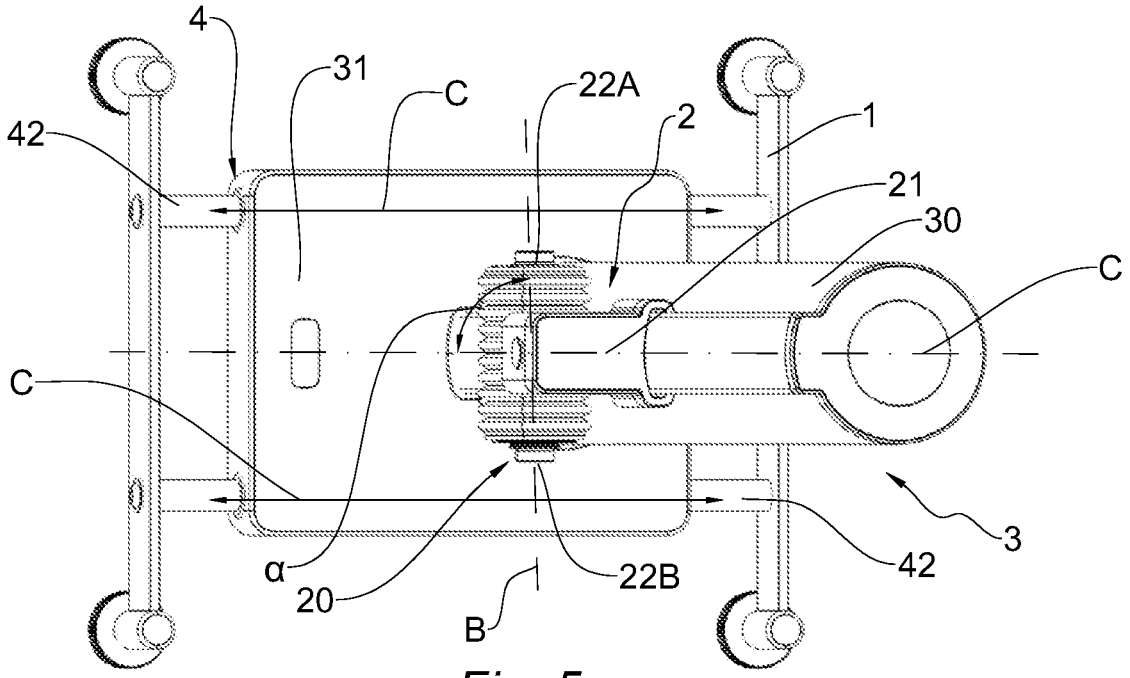
FIG. 5 is a top view of the support device in FIG. 1.

Preferably, the retention element 20 comprises a first and a second locking element 22A, 22B, visible in FIG. 5, each configured to lock a respective arm of the fork 201.

The locking elements 22A, 22B may for example be made in the form of pins, or a tube into which a quick-release screw is inserted, in such a way as to define a fixing structure similar to that defined by the ends of a common bicycle wheel hub.

It will therefore be appreciated that when the fork 201 is attached to the fixing group 2, the locking axis B coincides with the front wheel axle X of the bicycle 200.

Referring again to FIGS. 2 and 3, the support device 1 comprises a raising/lowering device 3 of the fixing group 2 which includes a guide element 30 preferably in the form of an elongated column.

In certain embodiments, a movable element 21 of the fixing group 2 may slide on the guide element 30 in such a way as to allow movements in the vertical direction V of the fixing group 2 and, in particular, of the retention element 20.

In this way the front end of the bicycle 200 may be raised or lowered, allowing it to be placed during training in a position similar to that which occurs on an uphill or downhill road.

Figure 6:
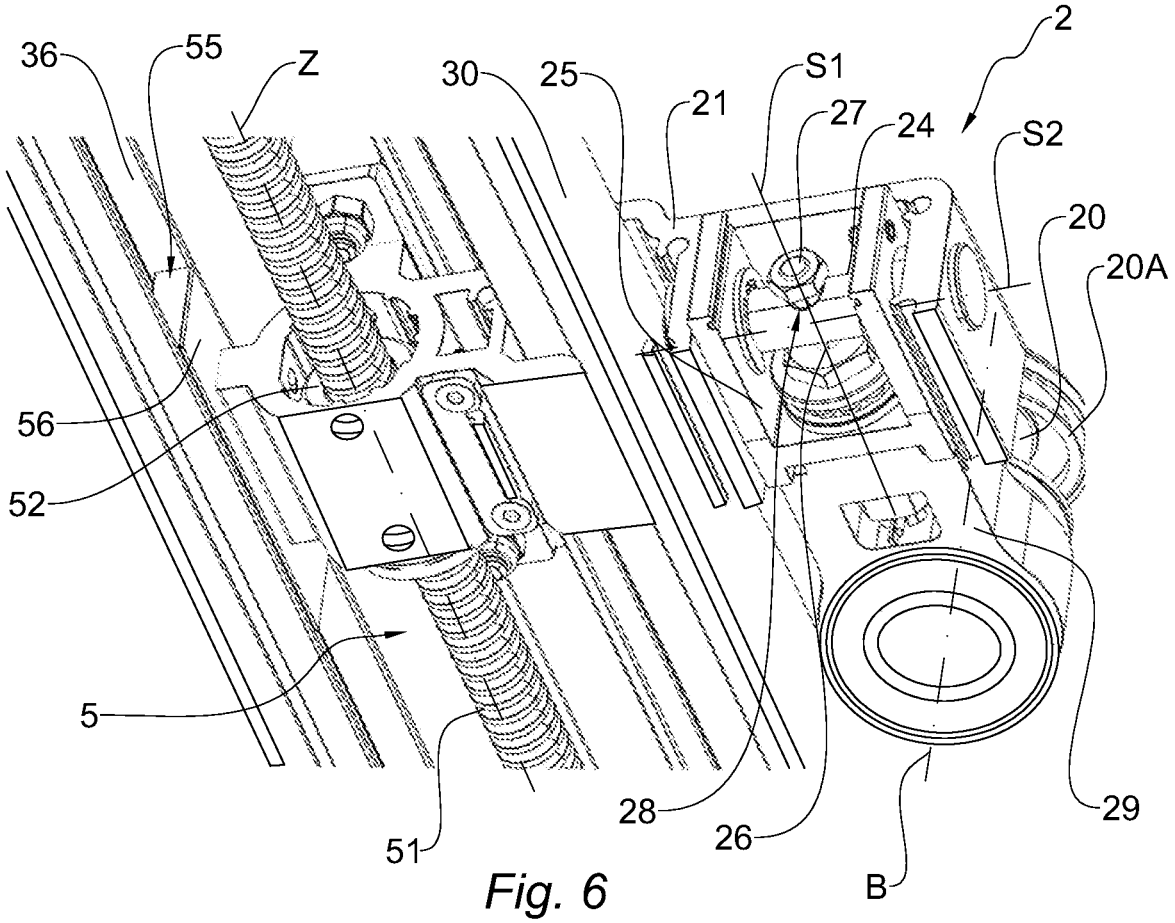
FIG. 6 is a perspective view, in detail and partially in section, of the support device of FIG. 1.

Referring now to FIG. 2, the movement of the fixing group 2 in the vertical direction takes place via special actuation means 5, shown in greater detail in an illustrative embodiment in FIG. 6.

Preferably said actuation means 5 comprise a screw 51 and an internally threaded bush 52. The screw is driven in rotation about an axis Z, preferably coinciding with the vertical axis V, by means of an electric motor 53 which may be associated with a reducer 54, the latter being shown in FIG. 2.

As may be seen in FIG. 6, the fixing group 2 is connected to the bush 52 and the rotation of the screw 51 determines the movement of the group 2 along the axis Z of the screw, said group 2 being slidably secured along the guide element 30. In this way, the vertical position of the fixing group 2, and thus of the front end of the bicycle, may be easily controlled via a control system, thus enabling optimal implementation of interactive training solutions.

In preferred embodiments, the actuation means 5 are housed within the column forming the guide element 30, with the motor 53 and the reducer 54 positioned at the base thereof.

Preferably, the actuation means 5 comprise an anti-rotation device 55 of the bush 52 with respect to the column guide element 30, so as to achieve the translation of the movable element 21 following the rotation of the screw 51. In some embodiments, the rotation device comprises slidable blocks 56 and corresponding seats 36 formed in the guide element 30.

Figure 4:
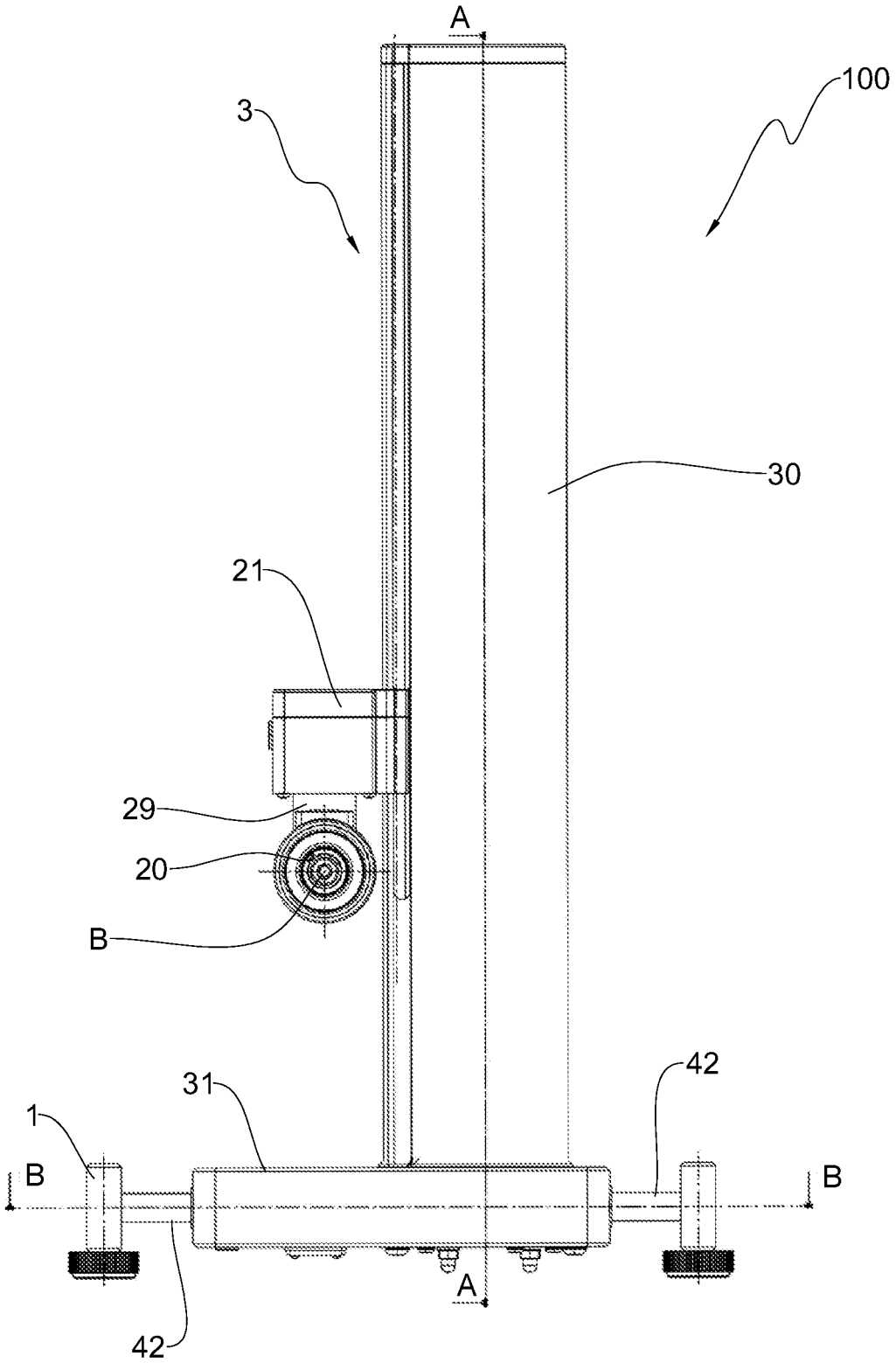
FIGS. 4, 4A and 4B are a side view from above and respective cross sections and longitudinal sections of the support device of FIG. 1.

With reference to FIGS. 3, 4 and 5, the raising/lowering device 3 may comprise a support base 31, which preferably has a substantially rectangular shape.

The guide element 30 is advantageously connected to this support base 31 and extends vertically therefrom.

Referring now to FIGS. 3 and 6, according to another aspect of the invention the retention element 20 is rotatably connected to said movable element 21.

As schematically illustrated in FIG. 5, the connection of the retention element 20 on the fixing group 2 may be configured in such a way that the retention element 20 may rotate in such a way that the locking axis B forms a variable angle $\alpha$ with said compensation direction C. Preferably said angle $\alpha$ may be between 90° and 60°, wherein 90° corresponds to the straight position of the fork 201. In this way, rotations of the handlebars of approximately ±30° from a central position may be permitted.

As illustrated in the example of FIG. 6, in some embodiments the retention element 20 is rotatable with respect to said movable element 21 with respect to a main axis S1 perpendicular to the locking axis B. Preferably, the main axis S1 is substantially vertical.

According to another aspect, the retention element 20 is rotatable with respect to the movable element 21, also with respect to a secondary axis S2 perpendicular to the locking axis B and the main axis S1.

The secondary axis S2 is preferably substantially horizontal.

Advantageously, the retention element 20 is also movable along the locking axis B.

In some embodiments, resilient return means 20A are provided which are configured to return the retention element 20 to a rest position, preferably to a central position with respect to extreme end-of-travel positions.

Preferably, the rotation of the retention element 20 may be obtained by means of a pin 24 connected to the movable element 21 and extending along the secondary axis S2.

A cradle 25 may be supported on the pin, on which an additional pin 26 is rotatably connected, which in turn supports a support arm 29 to which the retention element 20 is connected.

The retention element 29 may then be slidably connected to the support arm 29 in such a way as to allow translations along the locking axis B.

In some embodiments, the support device comprises angular detection means 23, illustrated schematically in FIG. 2, which are configured to detect an angular position of said retention element about said main axis S1 in such a way that the rotation of the fork, and thus the handlebar, may be detected during training.

The angular detection means 23 may be fixed on the cradle 25, for example using the seats 25A illustrated in FIG. 6, and may be placed in an overlying position at one end of the additional pin 26.

In some embodiments, the pin 26 supports a magnetic element 27 configured in such a way as to be detected by the angular detection means 23. The magnetic element 27 may be advantageously located at a longitudinal end of said additional pin 26.

In order to obtain a compact structure, a through-slot 28 in the pin 25 may be provided through which the additional pin 26 extends.

According to an aspect of the invention, the support base is connected to the support structure 1 by means of special connection means 4 which allow the base 31 to slide with respect to the support structure 1 along a compensation direction C, which is perpendicular to the vertical direction V.

Figure 7A:
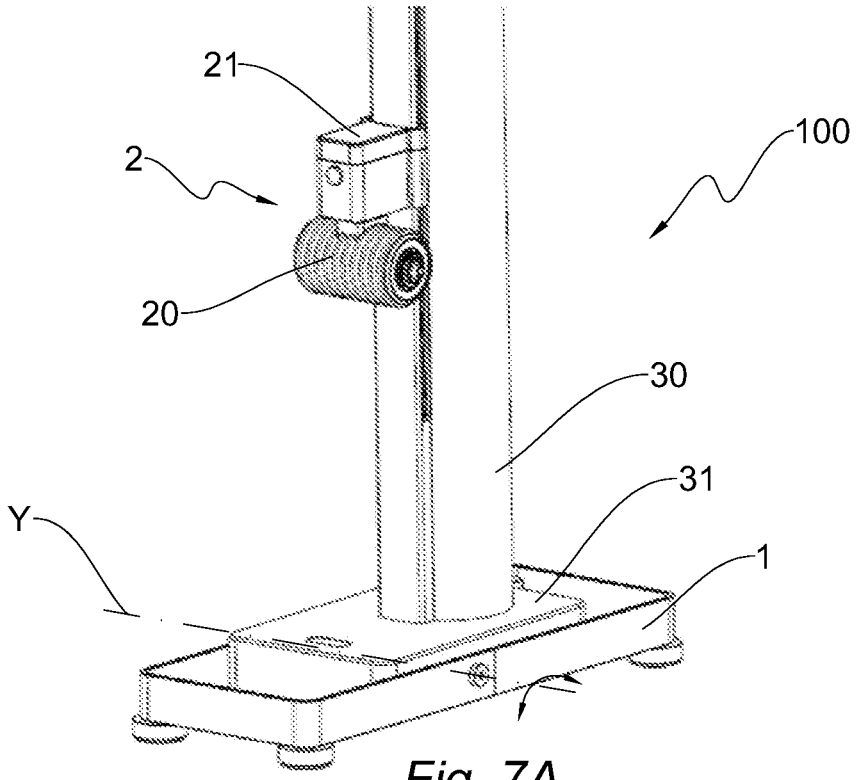
FIGS. 7A and 7B are two perspective views, front and rear respectively, of a variant embodiment of the support device of this invention.
Figure 7B:
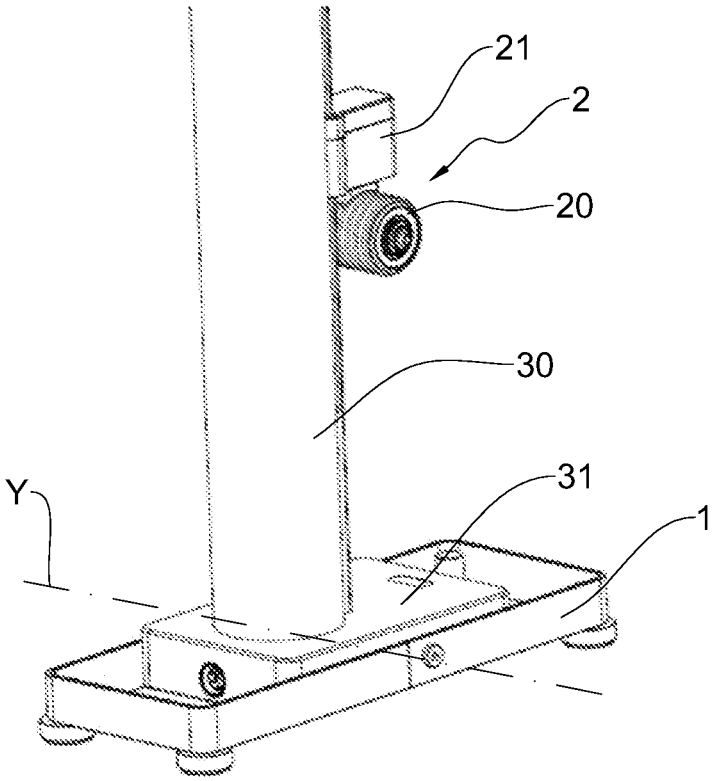

It will be appreciated that the sliding of the base 31 determines a corresponding sliding of the fixing group 2 and, more generally, the connection means 4 may also be configured differently, provided that they are suitable to secure the fixing group 2 to the support structure 1 in such a way as to allow movements of the group 2 along the compensation direction C. Said movement may occur either by translation or by rotation, for example by providing a hinge axis Y of the guide element 30 with respect to the support structure 1, in such a way that the guide element may oscillate with respect to the support structure about an axis substantially parallel to the locking axis B, such as for example illustrated in the embodiment of FIGS. 7A and 7B. Other suitable solutions for obtaining the compensation may, for example, be obtained by suitably shaping the support structure 1 so that it rests on the ground on a curved surface which allows the support device 100 to always swing about an axis substantially parallel to the locking axis B.

As may be seen in FIG. 1, the movements of the fixing group 2 along the compensation direction C allow the locking axis B to be moved closer to or further away from the training device 300. In this way, the correct distance between the training device 300 and the support device 100 may be maintained by following the inclination of the bicycle about its rear axle.

In some embodiments, the bicycle 200 may be fixed to the training device 300 in such a way that it may rotate, as a whole, about the rear axle XP. This prevents scraping between the bicycle 200 and the training device 300 at the locking zone when tilting up or down.

It will also be appreciated that although in the example embodiment shown in the figure the compensation direction substantially coincides with a horizontal direction parallel to the longitudinal development of the bicycle, embodiments may be envisaged in which the compensation direction C is inclined with respect to these directions, provided that it is not parallel to the vertical axis and the rear axis of the bicycle.

It is preferable, however, for the compensation direction C to be substantially parallel to the direction of longitudinal development of the support structure 1.

Figure 4A:
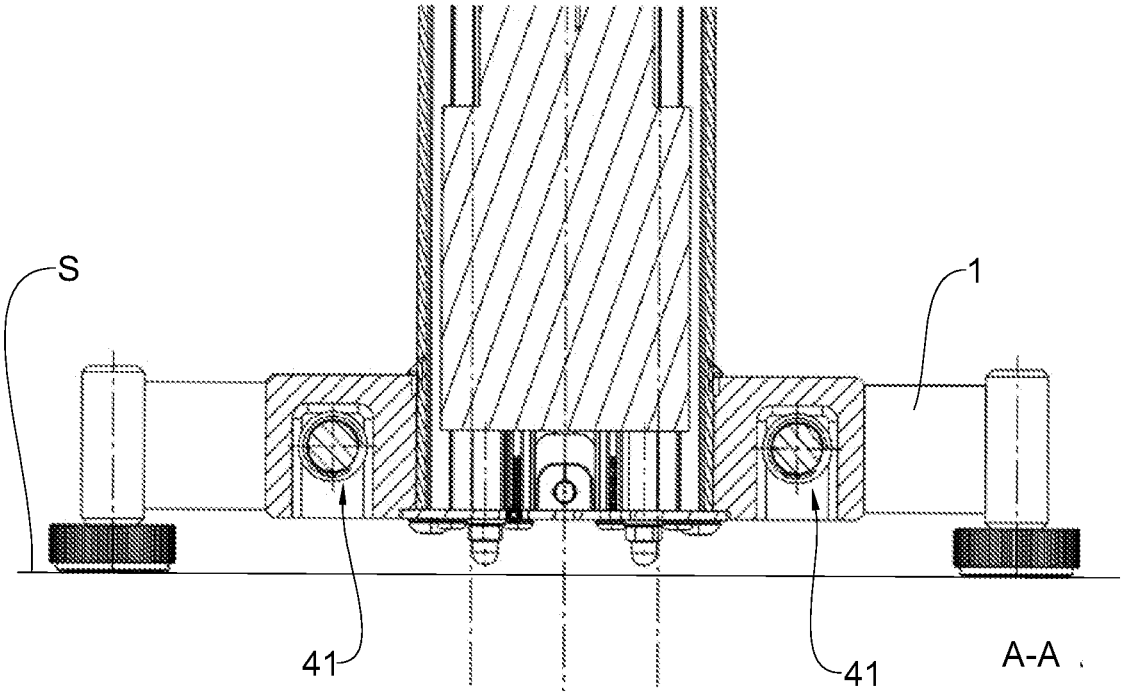
Figure 4B:
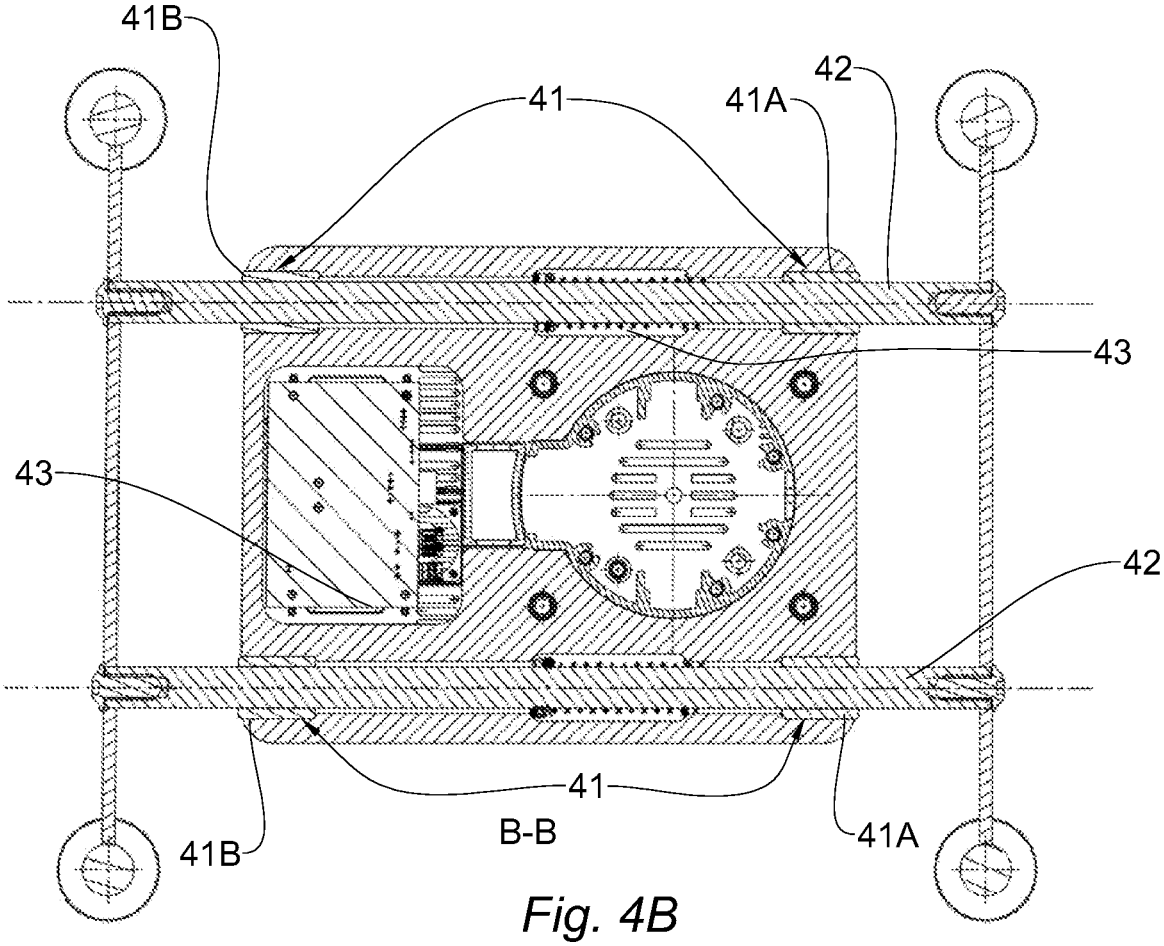

With reference now also to FIGS. 4A and 4B, a possible implementation of connection means 4 will be described.

In particular, in preferred embodiments the connection means may comprise a pair of rails 41 and respective sliders 42. Preferably there are two pairs of rails and respective sliders formed at transversely opposite ends of the device 100.

In some embodiments, the rails 41 are formed in the support structure 1 while the sliders 42 are supported on the raising/lowering device 3. However, it is evident that the opposite solution may also be envisaged.

Preferably, the sliders 42 are in the form of slidable rods in said rails 41.

In some embodiments each of the rails 41 may comprise a first and a second portion 41A, 41B arranged at opposite ends of the support structure 1 along the compensation direction C. In addition, a return element 43 may be provided which is configured in such a way as to urge the raising/lowering device 3 to an intermediate position along said compensation direction C between respective limit positions.

It will therefore be appreciated that a support device made in this way may make it possible to simulate, in a training session, conditions for the front end of the bicycle that are particularly similar to those that occur during actual cycling practice. This may be desirable if, for example, it is necessary to simulate realistically both uphill and downhill travel and to simulate any lateral deviations with respect to a straight travel position.

At the same time, the bicycle is supported in a stable and secure manner, benefiting the safety and comfort of the user.

The invention claimed is:

1. A support device for a bicycle including a handlebar and a respective front fork, said support device comprising a support structure which is configured to be supported on a support surface, a fixing group which is supported on said support structure and which comprises a movable element and a retention element which is configured to retain the front fork so as to define a locking axis for the front fork, the support device further comprising a raising/lowering device for said fixing group which is configured so as to move said movable element in a vertical direction, said retention element being translatable jointly with the movable element wherein, said retention element being rotatably connected to said movable element so as to allow rotation of the front fork of the bicycle, when retained to the retention element, by the rotation of the handlebar.

2. The support device according to claim 1, wherein the locking axis of the front fork coincides with a front wheel axle of the bicycle when the front fork is fixed to said fixing group.

3. The support device according to claim 1, wherein said retention element is rotatable with respect to said movable element with respect to a main axis perpendicular to said locking axis, said main axis being substantially vertical.

4. The support device according to claim 3, further comprising angular detection means which are configured to detect an angular position of said retention element about said main axis.

5. The support device according to claim 4, wherein said retention element is rotatable with respect to said movable element with respect to a secondary axis perpendicular to said locking axis and said main axis, said secondary axis preferably being substantially horizontal.

6. The support device according to claim 5, wherein said fixing group comprises a pin which is connected to said movable element and which extends along said secondary axis and which supports a cradle, to which an additional pin is rotatably connected, which supports a support arm to which said retention element is connected.

7. The support device according to claim 6, wherein the additional pin supports a magnetic element which is configured so as to be detected by said angular detection means.

8. The support device according to claim 1, wherein said retention element is translatable along said locking axis.

9. The support device according to claim 8, comprising resilient return means which are configured to return said retention element to a rest position, preferably to a central position with respect to extreme end-of-travel positions of a translation movement along said locking axis.

10. The support device according to claim 1, wherein said raising/lowering device comprises a guide element with a vertical development.

11. The support device according to claim 10, wherein the guide element is secured to said support structure so as to be able to oscillate with respect to said support structure about an axis which is substantially parallel to said locking axis.

12. The support device according to claim 1, further comprising connection means which are configured to slidably secure said fixing group to said support structure so as to allow movements of said fixing group with respect to said support structure in a compensation direction which is transverse to said vertical direction.

13. The support device according to claim 12, wherein said connection means comprise a pair of rails with respective sliders which slide in said rails, and wherein said support structure comprises said sliders and said raising/lowering device comprises said rails, or said support structure comprises said rails and said raising/lowering device comprises said sliders.

14. The support device according to claim 13, wherein said connection means comprise a return element which is configured so as to urge said raising/lowering device into an intermediate position in said compensation direction between respective limit positions.

15. The support device according to claim 1, wherein said raising/lowering device comprises actuation means of said fixing group which are configured to move in translation said fixing group in the vertical direction, said actuation means comprising a screw and an internally threaded bush, said fixing group being connected to said internally threaded bush.

* * * * *